US006484711B2

(12) United States Patent
Acker et al.

(10) Patent No.: US 6,484,711 B2
(45) Date of Patent: Nov. 26, 2002

(54) AUTOMATIC DEPTH OF CUT CONTROL FOR CONCRETE SAW

(75) Inventors: Brad V. Acker, Boise, ID (US); J. Brandal Glenn, Boise, ID (US); Greg K. Yarlott, Nampa, ID (US); Tim S. Jaszkowiak, Boise, ID (US)

(73) Assignee: Multiquip, Inc., Carson, CA (US)

( * ) Notice: Subject to any disclaimer, the term of this patent is extended or adjusted under 35 U.S.C. 154(b) by 0 days.

(21) Appl. No.: 09/792,852

(22) Filed: Feb. 23, 2001

(65) Prior Publication Data

US 2002/0117160 A1 Aug. 29, 2002

(51) Int. Cl.[7] ..... B24B 23/00
(52) U.S. Cl. ..... 125/13.01; 125/14; 451/352
(58) Field of Search ..... 125/13.01, 14; 299/39.3; 451/352

(56) References Cited

U.S. PATENT DOCUMENTS

| | | | | | |
|---|---|---|---|---|---|
| 2,700,256 | A | | 1/1955 | Lewis | 51/170 |
| 4,176,721 | A | | 12/1979 | Poggemiller et al. | 172/4 |
| 4,673,219 | A | | 6/1987 | Perciful | 299/39 |
| 4,840,431 | A | * | 6/1989 | Jedick | 299/39 |
| 4,953,523 | A | | 9/1990 | Swan | 125/14 |
| 5,381,780 | A | * | 1/1995 | Yelton et al. | 125/14 |
| 5,435,065 | A | | 7/1995 | Raczykowski | 30/382 |
| 5,809,985 | A | * | 9/1998 | Kingsley et al. | 125/13.01 |
| 5,950,612 | A | | 9/1999 | Zuzelo et al. | 125/13.01 |
| 6,019,433 | A | * | 2/2000 | Allen | 299/39.3 |
| 6,135,567 | A | | 10/2000 | Cochran | 299/39.6 |

* cited by examiner

*Primary Examiner*—Robert A. Rose
(74) *Attorney, Agent, or Firm*—Frank J. Dykas; Robert L. Shaver; Stephen M. Nipper

(57) ABSTRACT

An automatic depth of cut control for use with concrete saws. The control allows an operator to set a maximum depth of cut for which the concrete saw can be used at. Further, the control allows the user to move the concrete saw from one location to another without needing to reset the depth of cut.

8 Claims, 9 Drawing Sheets

AUTOMATIC DEPTH OF CUT CONTROL FOR CONCRETE SAW

BACKGROUND OF THE INVENTION

1. Field of the Invention

The present invention generally relates to depth of cut control for saws, and in particular to depth of cut control for concrete saws.

2. Background Information

Concrete saws are used to cut grooves in concrete surfaces so as to control the cracking which inevitably occurs as the concrete cures or hardens. They are used to cut grooves to form a fracture line in the surface of the concrete such that if and when the concrete does crack, it will crack along the cut line. This is done to prevent heaving and irregular surfaces which would inevitably occur otherwise.

The typical concrete saw is a self-propelled unit which has a main power engine which is used to drive a rotary, diamond-tipped saw blade, and an electrically driven hydraulic system which is used to raise and lower the saw.

The typical concrete saw has a mainframe and a set of rear drive wheels which are affixed to the mainframe and can be driven at a selectable speed. Attached to the mainframe is a sub frame with a second set of wheels, which is movable, normally by means of an independent hydraulic system to raise and lower the front of the concrete saw and the saw blade. This is done so that the saw blade can be elevated above the surface either for repair or replacement of the blade, or to move the saw from one location to another. The sub frame is then lowered down until the saw blade engages the concrete, and starts to cut into it. The operator can then continue to lower the blade as it cuts into the concrete to a selected depth of cut.

In selecting the depth of cut, there are a number of variables which include the diameter of the saw blade being used, depth of the concrete, the speed at which the blade is turning, and the drive speed at which the concrete saw is advanced along the line of cut. In general, the thicker the concrete surface the deeper the cut should be, yet the cut should not be so deep as to ensure complete fracturing along the cut line which subjects the concrete surface to inevitable fracture, and the possibility of heaving such as that induced by freezing of the subsurface and inevitable thawing during the change of seasons.

While devising a method of measuring the depth of cut might seem to be a simple matter, it is not in that depth of cut has to be calibrated for bearing diameters of the saw blades that are used on a concrete saw. And, for the topography, for example whether or not the cut is vertical on an inclined concrete surface such as those encountered on roads, sidewalks and driveways.

Accordingly, it is the object of this invention to provide a depth of cut apparatus which is adjustable in that it can be easily recalibrated for varying conditions and sizes of saw blades, and also will automatically stop at a preselected depth of cut when the saw is lowered the concrete surface being cut.

SUMMARY OF THE INVENTION

The present invention is an apparatus/method for use with concrete saws (or other cutting devices which have elevationally adjustable means for cutting grooves, slots, or trenches in the surface of a material at a selectable depth of cut). The invented apparatus automatically resets the depth of cut after the elevation of the saw or other cutting device has been changed from a selected depth of cut to another depth or elevation. One embodiment of the invented apparatus is utilized with a concrete saw having a rotating saw attached to elevationally adjustable means which is movably attached to a frame. The invented apparatus having a means for determining the elevation of the saw blade, relative to the surface of the material to be cut attached to the elevation means. The invented apparatus further having a means for identifying the elevation of the saw or other cutting device, relative to the surface of the material being cut, when the saw or other cutting device is cutting at a preselected depth of cut. The invented apparatus further having a means for automatically stopping elevational movement of the saw or other cutting device at the elevation of the preselected depth of cut when the elevation of the saw or other cutting device is adjusted to return it to the preselected depth of cut.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
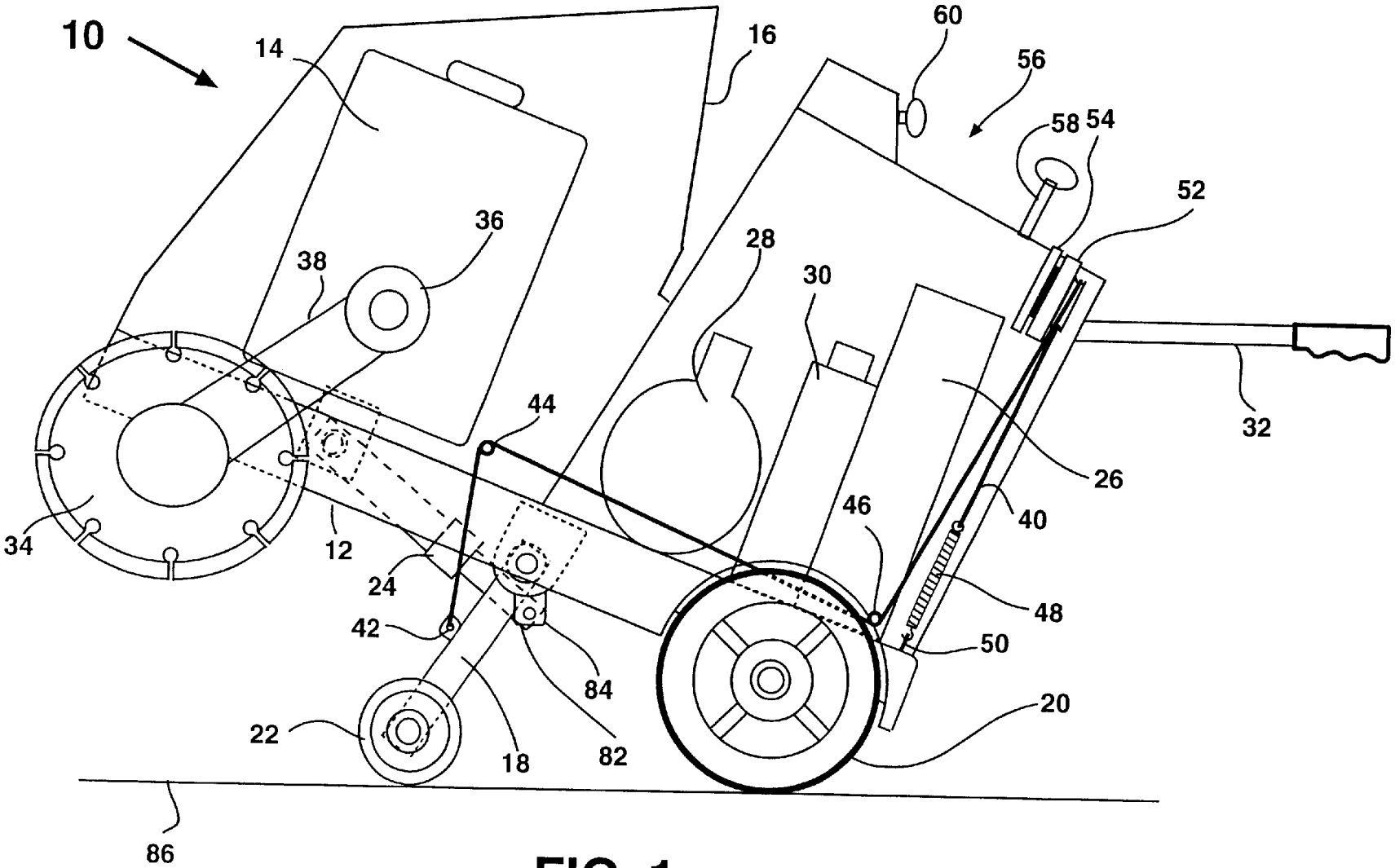
FIG. 1 is a sectional representational side view of a concrete saw having a first embodiment the automatic depth of cut control, said concrete saw shown in its raised position.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 2:
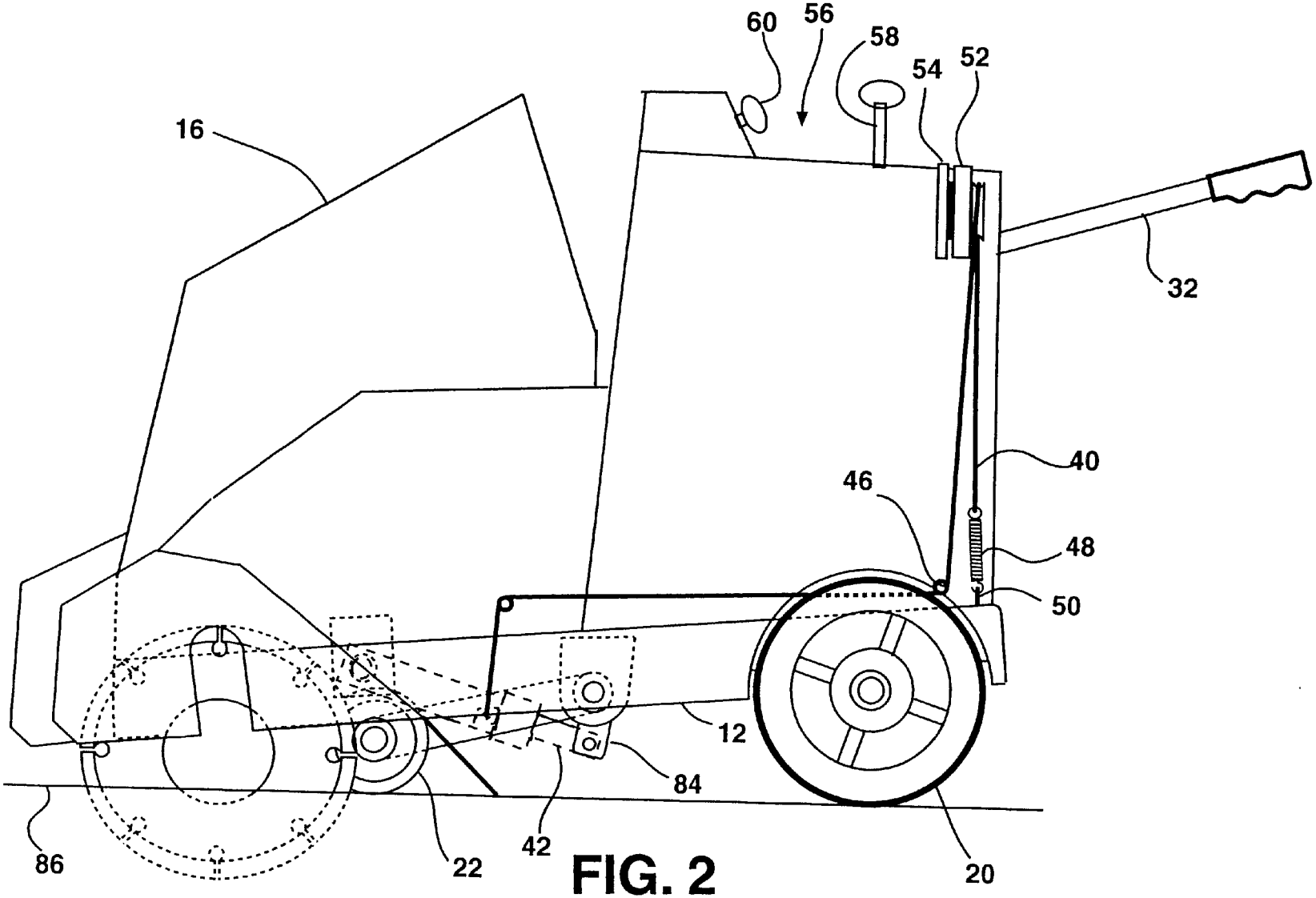
FIG. 2 is a sectional representational side view of a concrete saw having a second embodiment of the automatic depth of cut control, said concrete saw shown in its lowered position.

Referring first to FIG. 1, there is shown a representational sectional side view of a concrete saw 10 in an elevated position. FIG. 2 is a representational sectional side view of a concrete saw 10 in a lowered position. Referring again to FIG. 1, at the base of the concrete saw is mainframe 12 and sub frame 18. Sub frame 18 is attached to sub frame shaft 82 which is attached to mainframe 12, and is driven by means of hydraulic cylinder 24 which is attached to pivot arm 84 which is used to raise and lower the front half of the concrete saw 12 so as to adjust the height of the saw blade 34 to either elevate it for purposes of moving the concrete saw 10, replacing saw blade 34, or controlling the depth of cut of saw blade 34 in concrete surface 86. It is also envisioned that the invented apparatus/method may be used with other versions of cutting devices, including those having the cutting means mounted on a pivoting arm, wherein the cutting means attached to the pivoting arm is the portion of the device which is raised and lowered. While this disclosure stresses the mainframe/sub frame style of cutting device, all other types of devices are also included.

Saw blade 34 is attached to a conventional arbor, and is driven by engine 14 housed within engine shroud 16 by means of engine drive pulley 36 and a plurality of drive belts 38. The operator of the concrete saw 10 stands behind the unit, and guides the concrete saw 10 by means of a pair of handles 32, and controls the saw with a variety of controls conveniently positioned for the operator on control panel 56, and which include, engine throttle 60 and saw blade clutch control 58.

Hydraulic cylinder 24 is, in a typical concrete saw 10, controlled by means of an electrically driven hydraulic unit 26 which includes an electric motor, a hydraulic pump and an accumulator. Power is supplied to hydraulic unit 26 by means of a generator or alternator attached to engine 14 and/or battery 30. The purpose of the independent electrically powered hydraulic unit 26 is to enable the operator to elevate the concrete saw 10 without engine 14 running. This is a standard feature which enables the operator to replace the saw blade 34 without the possibility of the saw engine 14 being inadvertently turned on. Other, non-hydraulic cylinder manners of actuation are included in this disclosure, including, but not limited to all types of linear and rotary actuation.

A drive transmission 28 is used, in a conventional manner, to drive wheels 20 at a selected speed. The concrete saw 10 is supported at all times by four wheels, the first being the rear pair of drive wheels 20 and the second set being sub frame wheels 22.

Figure 3:
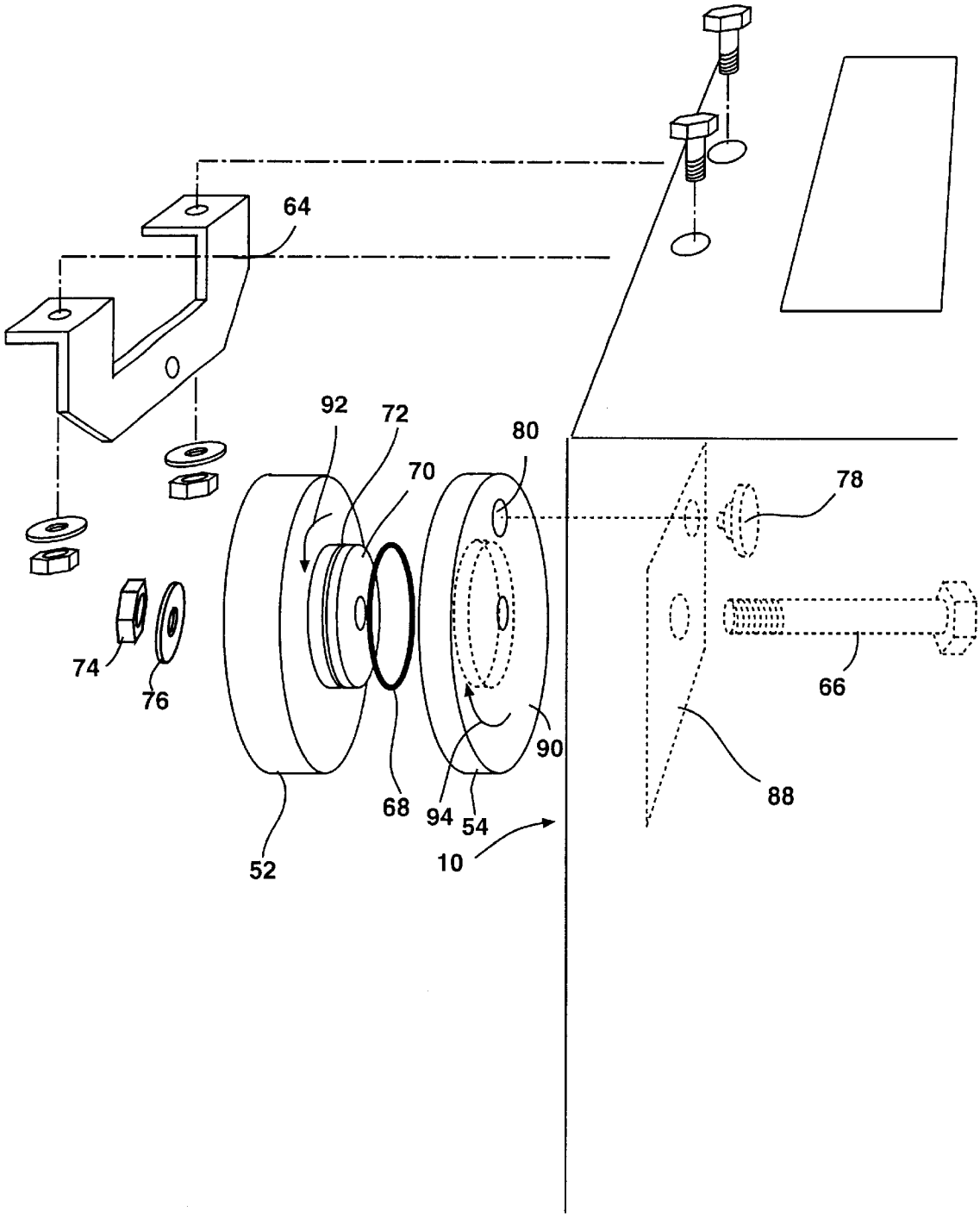
FIG. 3 is an exploded representational prospective view of a third embodiment of the automatic depth of cut control.
Figure 4:
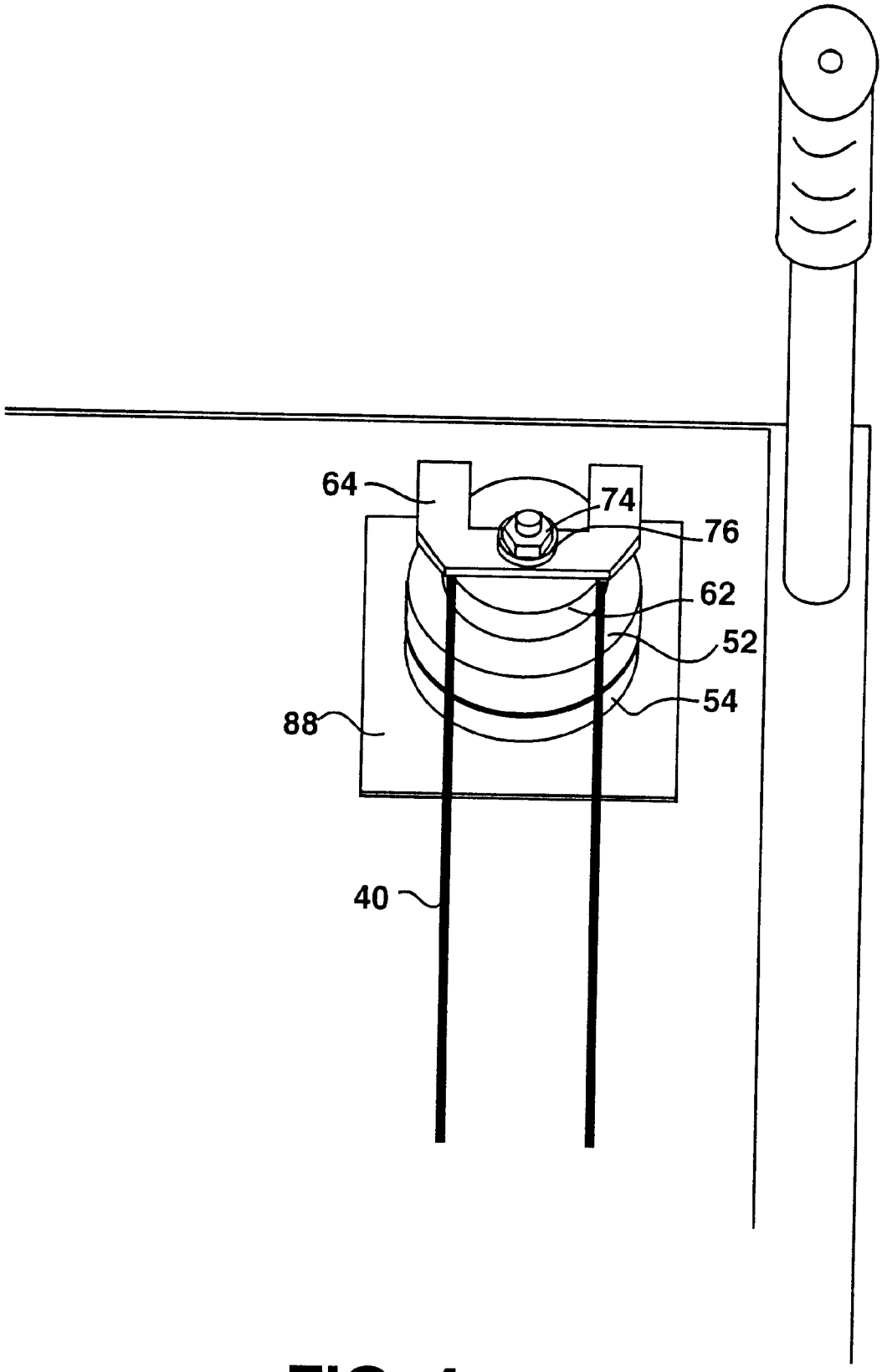
FIG. 4 is a perspective representational bottom view of a fourth embodiment of the automatic depth of cut control as installed on the concrete saw.

In order to have automatic depth of cut control, it is necessary to have some sort of sensing mechanism which can be used to identify the elevation of the saw relative to the concrete surface 86. There are a variety of ways of accomplishing this, which include sensing units which sense the extension of hydraulic cylinder 24, electronic sensors which can sense the angle at which mainframe 12 is positioned, ultrasonic sensors, proximity sensors, mechanical sensors, and in the preferred embodiment, a cable arrangement. In the preferred embodiment, cable 40 is attached to cable anchor point 42 on sub frame 18. Cable 42 is then spooled around idler pulleys 44 and 46, and then around spool 62 on the depth of cut indicator wheel 52 and attached to spring 48, which itself is anchored to mainframe 12 as shown in FIGS. 3 and 4. In this manner, as the front end of the concrete saw 10 is lowered down toward the concrete surface 86, the distance between anchor point 42 and idler pulley 44 becomes shorter, causing spring 48 to take up the slack, thus translating the elevation of the saw into rotational movement of depth of cut indicator wheel 52.

In the preferred embodiment, spring 48 is sized and tensioned so as to allow the operator to override the frictional forces between cable 40 and spool 62 to so as to calibrate the zero point for depth of cut indicator wheel 52 to compensate for varying diameters and sizes of saw blades 34. This is accomplished by lowering concrete saw 10 until concrete saw blade 34 just touches concrete surface 86 and then manually turning depth of cut indicator wheel 52 to the zero position.

Now referring to FIG. 3 there is shown an exploded representational perspective view of one embodiment of the automatic depth of cut control system. It includes depth of cut indicator wheel 52 and depth of cut selector wheel 54 which interfits over depth of cut selector spool shaft 70 which is formed integral with depth of cut indicator wheel 52, O-ring 68 is provided to provide significant frictional engagement between depth of cut selector wheel 54 and depth of cut indicator wheel 52 so that depth of cut selector wheel 54 will automatically rotate in conjunction with depth of cut indicator wheel 52 when it is rotated by means of movement of cable 40 which is in frictional engagement with spool 62 (as shown in FIG. 7), yet at the same time, not to have frictional engagement to the extent that it is possible to manually rotate either depth of cut indicator wheel 52 or depth of cut selector wheel 54 independent of each other.

The depth of cut indicator wheel 54 and the depth of cut selector wheel 52 may be located in a variety of locations upon or within the mainframe 12. In one embodiment of the invention shown in FIG. 4, these wheels 52, 54 are located in a fixed relationship upon a side of the mainframe 12. The support plate 88 is connected to the outer surface of the concrete cutting device. The support plate 88 is then also connected to the combination of the depth of cut selector wheel 54, the depth of cut indicator wheel and the selector spool shaft 70. This combination is held in place by a bracket 64.

Figure 5:
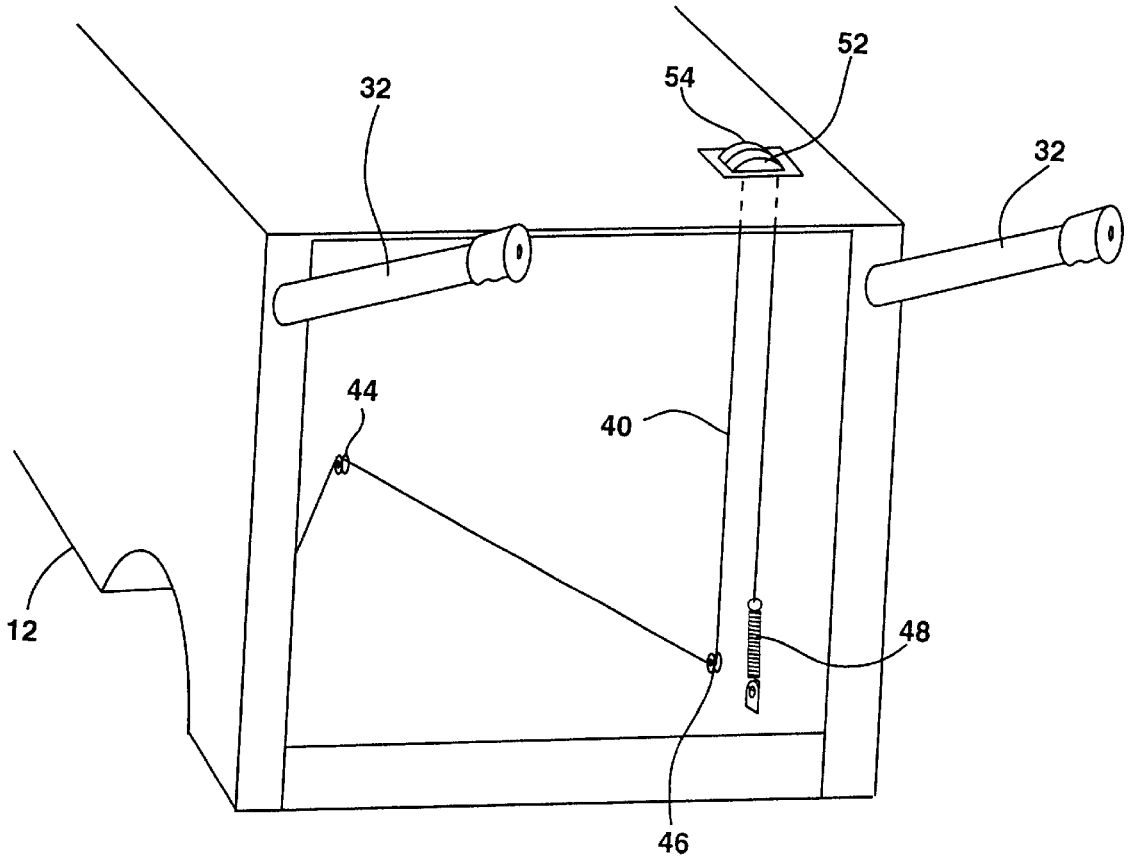
FIG. 5 is a perspective representational view of a fifth embodiment of the automatic depth of cut control, installed on the concrete saw.

FIG. 5 shows another embodiment of the invention wherein these wheels 52, 54 are located within the mainframe 12 of the cutting device and are accessible from the top of the mainframe 12. This embodiment allows a user of the device to see the wheels 52, 54 while holding the handles 32 of the device.

Figure 7:
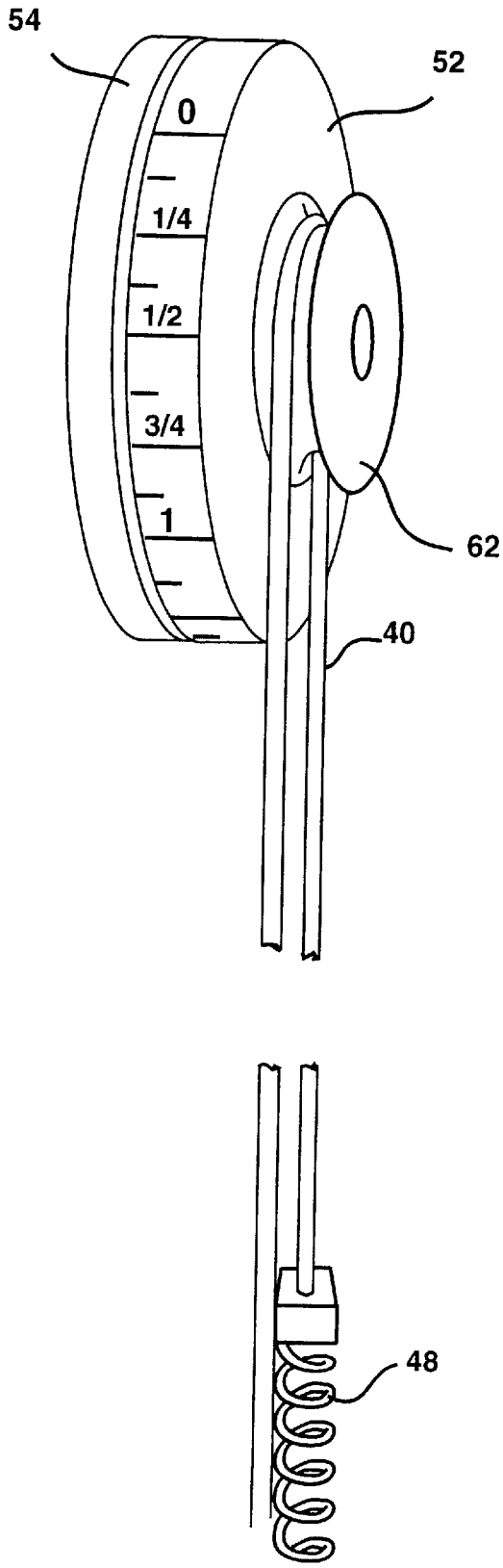
FIG. 7 is a partial, perspective view of a seventh embodiment of the automatic depth of cut control of the present invention.

FIG. 7 shows the embodiment shown in FIG. 4 wherein the depth of cut selector wheel 52 has a variety of markings to indicate the elevation of the depth of cut. This figure also shows a spool 62 which assists to maintain a frictional fit between the depth of cut selector wheel 52 and the depth of cut indicator wheel 54. This spool 62 also frictionally interacts with means of movement cable 40 to adjust the depth or the elevation of the cut.

In addition to varying the locations of the depth of cut selector wheel 52 and the depth of cut indicator wheel 54, the invention provides a means for automatically preventing the cutting blade from cutting deeper than desired. Referring now to FIGS. 3, 6, 8, 9, and 10, embodiments of the invention are shown wherein a micro switch 78 is located on support plate 88 and is engaged with depth of cut selector wheel 54. A slot 80 is formed within depth of cut selector wheel 54 and is configured for engagement with micro switch 78. As long as micro switch 78 is pressed against surface 90 of the depth cutter selector wheel 54, the switch 78 is maintained in a closed position. When the micro switch 78 is in a closed position, the operator can operate the hydraulic system to lower sub frame 18. However, when a selected depth of cut is reached, the slot 80 within the depth of cut selector wheel rotates over the micro switch 78. When the slot 80 is over the micro switch 78, the switch is no longer in a closed position, but is in an open position. In this open position, the system of hydraulics 24 is prevented from lowering the cutting portion of the concrete saw 34.

The micro switch 78 is wired into the circuit so as to be overriddden for purposes of elevating the concrete saw regardless of whether or not micro switch 78 is open or closed. However, when a designated depth is reached, the slot 80 is rotated over the micro switch 78, the micro switch 78 switches from a closed position to an open position thereby disabling the hydraulic system in such a manner as to preclude any further lowering of the cutting saw 34.

Figure 8:
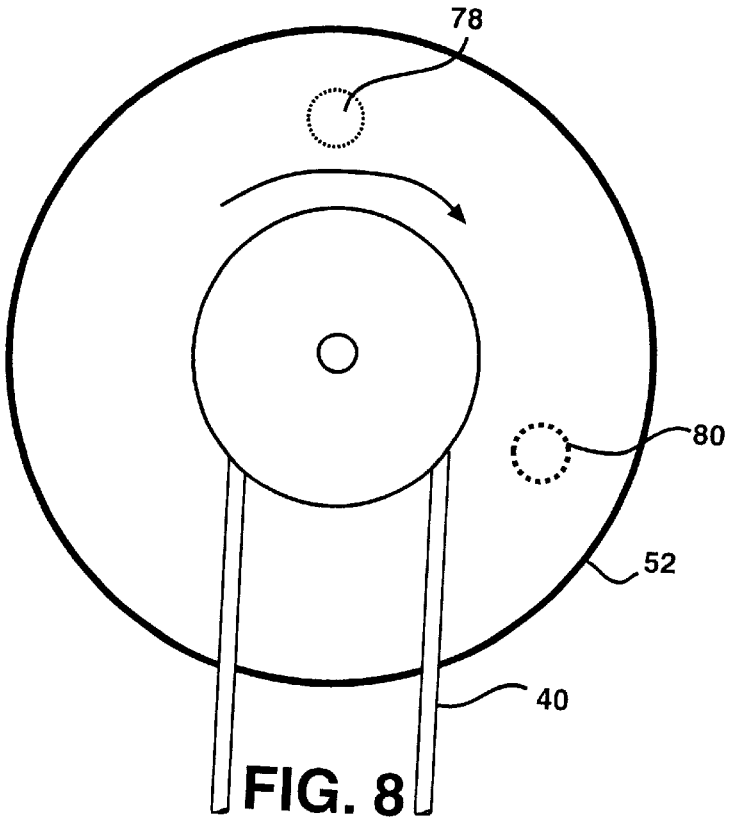
FIG. 8 is a partial, end view of an eighth embodiment of the automatic depth of cut control of the present invention.

FIG. 8 shows a detailed front view of one embodiment of the invention showing the location of the micro switch 78 and the slot 80. The micro switch 78 is in a closed position against the rear portion of the depth cut selector wheel 52. As the cable means 40 engages and turns the depth of cut selector wheel 52, position of the slot will also rotate. The frictional compressing arrangement between the depth of cut selector wheel 52 and the depth of cut indicator wheel 54 allows the depth of cut selector wheel 52 to rotate at the same pace as the depth of cut indicator wheel 54. When the cutting saw 34 is at the depth of a preselected desired depth of cut, the depth of cut indicator wheel 54 will rotate so as to align the slot 80 in to a position whereby the slot 80 meets the micro switch 78. When this occurs, the micro switch 78 will be opened, and the hydraulic cylinder will be prevented from any further lowering.

Figure 9:
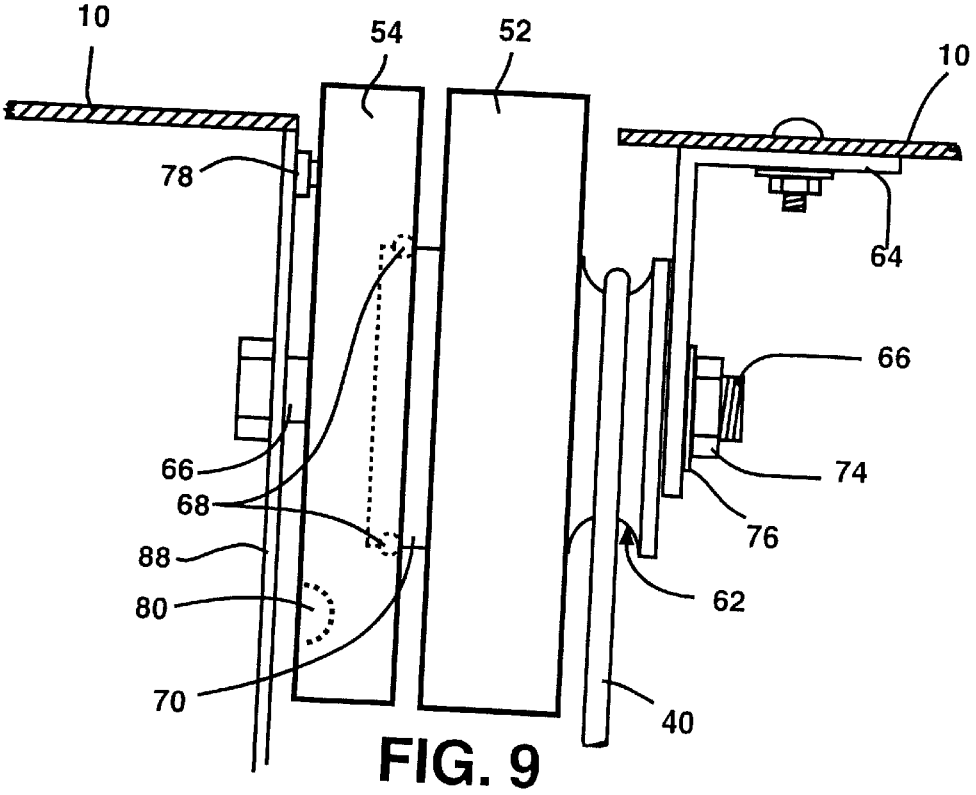
FIG. 9 is a side, environmental view of a ninth embodiment of the automatic depth of cut control of the present invention.
Figure 10:
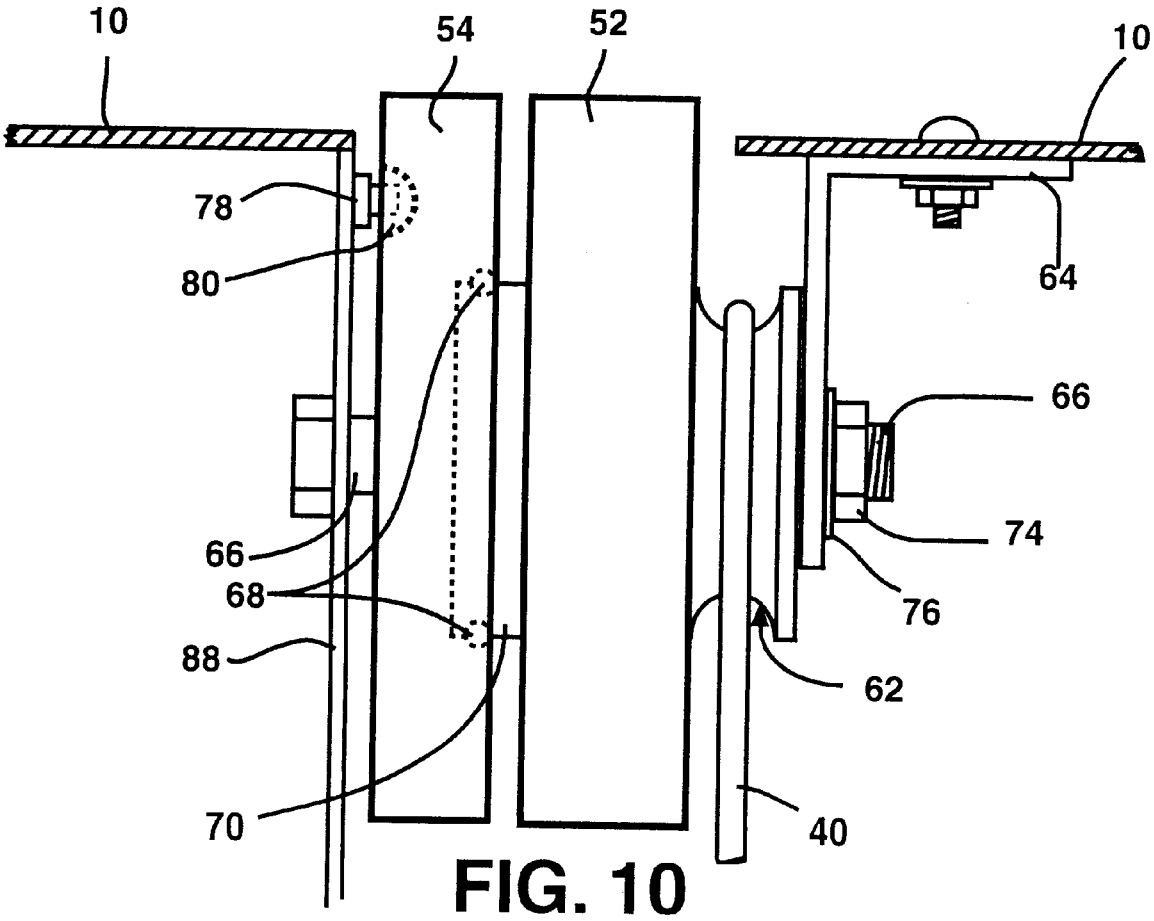
FIG. 10 is a side, environmental view of a tenth embodiment of the automatic depth of cut control of the present invention.

In FIGS. 9 and 10, two detailed side views of the embodiment shown in FIG. 5 are shown. In both FIGS. 9 and 10, the automatic depth control wheels 52, 54 are rotatably attached to shaft 66 by means of a washer 76 and bolt 74 which are connected to the support plate 88 and bracket 64. The support plate 88 and support bracket 64 are attached to the mainframe 12.

In FIG. 9, the micro switch 78 is engaged by the depth of cut indicator wheel 54. As long as this switch 78 is engaged by the wheel 54, the hydraulic system is operable to lower the cutting saw 12. However, when, as shown in FIG. 10, the slot 80 is placed over the micro switch 78, the switch fails to be engaged, the lowering capabilities of the hydraulic system are disabled, and depth of the cut cannot be lowered any further.

Figure 6:
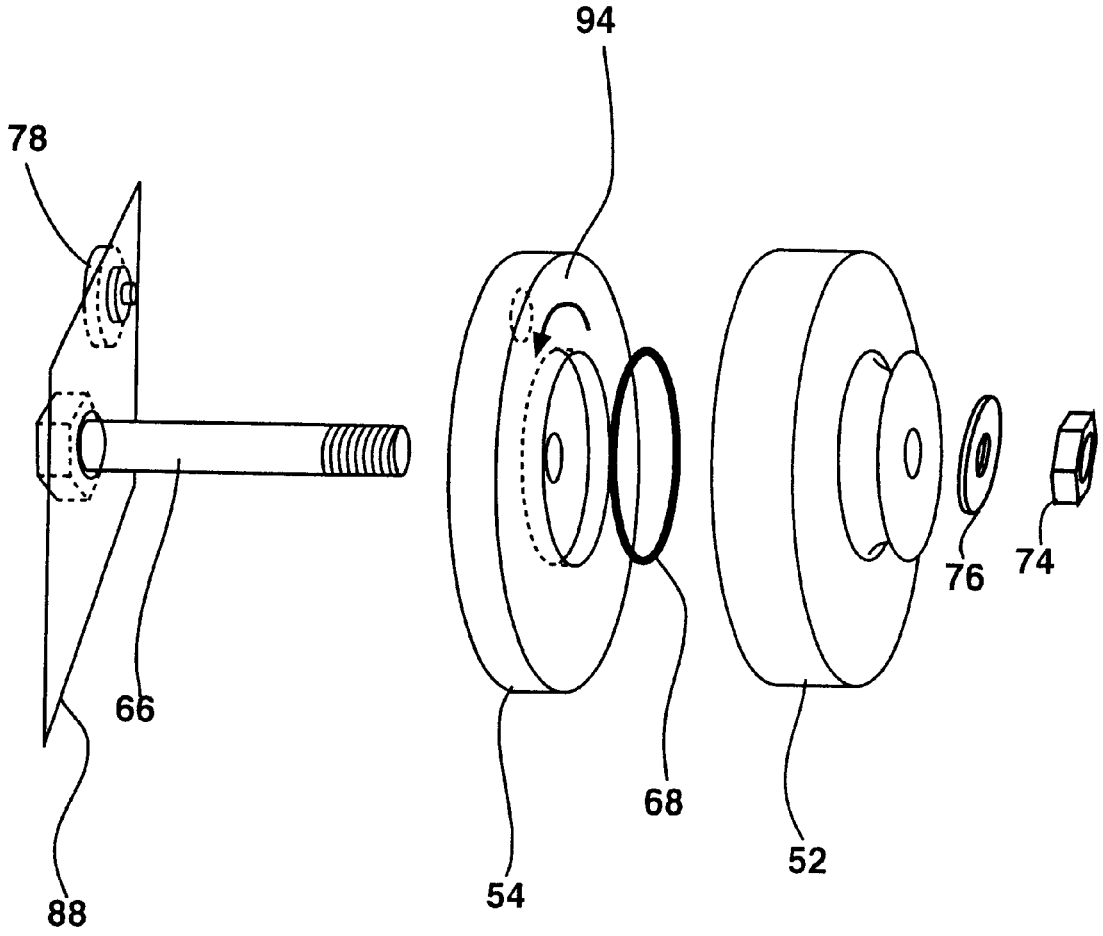
FIG. 6 is an exploded representational prospective view of a sixth embodiment of the automatic depth of cut control.

As shown in FIGS. 3 and 6, a micro switch 78 is located at top dead center on support plate 88 and is in engagement with front surface 90 of depth of cut selector wheel 54. A slot 80 is formed in depth of cut selector wheel 54 and configured for engagement with micro switch 78. FIG. 8 further shows the switch 78 and the slot 80. Micro switch 78, as long as it is pressed against the surface 90 of depth of cut selector wheel 54 is in the closed position, which enables the operator to operate the hydraulic system to lower sub frame 18. Micro switch 78 is wired into the circuit so as to be overridden for purposes of elevating concrete saw 10 irregardless of whether or not micro switch 78 is open or closed. When depth of cut selector wheel 54 rotates to a position wherein micro switch 78 drops into slot 80, micro switch 78 switches from a closed position to an open position thereby disabling the hydraulic system in such a manner as to preclude any further lowering of the elevation of concrete saw 10.

In use, the operator first calibrates the depth of cut indicator wheel 52 by lowering concrete saw 10 to an elevation wherein saw blade 34 just touches concrete surface 86 and then manually overrides the frictional force of cable 40 by turning depth of cut indicator wheel 52 to the zero position. When the elevation of concrete saw 10 is further lowered in the preferred embodiment, depth of cut indicator wheel 52 will be rotated in the direction of arrow 92 and depth of cut selector wheel will rotate the same direction. The operator can, after calibration of depth of cut indicator wheel 52 then rotate depth of cut selector wheel 54 in the direction of arrow 94 to select a depth. When depth of cut selector wheel 94 is rotated, slot 80 will be disengaged from micro switch 78 and will be pressed against surface 90 to a closed position. Then, as the concrete saw 10 is further lowered into a cut, depth of cut selector wheel 54 will rotate with depth of cut selector wheel 52 in the direction of arrow 92 and the concrete saw will continually be elevationally lowered into the cut until again slot 80 comes into alignment with micro switch 78 to disable further lowering.

The use of two wheels, the depth of cut indicator wheel 52 and the depth of cut selector wheel 54 has been selected as the preferred embodiment, primarily because of the harsh environment in which the saw is used. When sawing concrete, there is a lot of abrasive concrete dust and sometimes water droplets from the water spraying cooling system for the saw blade 34 are generated. As a result, this mechanical system is the preferred embodiment. However, it should be apparent to those skilled in the art that the same results can be achieved electronically using rather simple and basic electronic circuits to both sense the elevation of concrete saw 10 and to store electronically a selected depth of cut. While at the time that this application is filed, the applicant has not yet developed an electronic embodiment for the present invention, it should be apparent to those skilled in the art that the same can easily be done.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

We claim:

1. An apparatus, for use with cutting devices having elevationally adjustable means for cutting slots in the surface of a material at a selectable-depth of cut, said apparatus for automatically resetting the depth of cut, after the elevation of the cutting device has been changed from a selected depth of cut to another depth or elevation, said apparatus comprising:

means for determining the elevation of the cutting device, relative to the surface of the material, when the saw or other cutting device is cutting into the surface of the material;

means for identifying the elevation of the cutting device, relative to the surface of the material being cut, when the saw or other cutting device is cutting at a preselected depth of cut; and means for automatically stopping elevational movement of the cutting device at the elevation of the preselected depth of cut when the elevation of the cutting device relative to the surface of the material is determined by said means for determining elevation, to be at the elevation of the preselected depth of cut.

2. In a concrete saw, having a rotating saw blade attached to an elevationally adjustable means which is movably attached to a frame, for cutting grooves, slots, or trenches in the surface of a material at a selectable depth of cut, an apparatus for automatically setting the depth of cut, which comprises:

means for determining the elevation of the saw blade, relative to the surface of the material to be cut;

means for identifying the elevation of the saw blade relative to the surface of the material being cut, when the saw is cutting at a preselected depth of cut; and means for automatically stopping elevational movement of the saw blade at the elevation of the preselected depth of cut when the elevation of the saw blade relative to the surface of the material being cut is determined by the means for determining elevation of the saw blade to be at the preselected depth of cut.

3. In a concrete saw, having a rotating saw attached to elevation adjustment means which is movably attached to a frame, for cutting grooves, slots, or trenches in the surface of a material at a selectable depth of cut, an apparatus for automatically setting the depth of cut, which comprises:

a shaft attached to the concrete saw in fixed relationship to the frame;

a depth of cut indicator wheel, having an inner side and an outer side, rotatably mounted on the shaft;

a spool attached to the outer side of said depth of cut indicator wheel and configured to receive in frictional engagement a cable;

a depth of cut selector wheel rotatably mounted on said shaft between said between said depth of cut indicator wheel and a portion of the concrete saw fixed to the frame, set depth of cut selector wheel being in sufficient frictional engagement with said depth of cut indicator wheel to enable simultaneous rotation when said depth of cut indicator wheel is rotated about the shaft yet also capable of independent manual rotation, said depth of cut selector wheel having a slot for receiving a switch and further having indicia in fixed relationship to said slot;

a switch attached to the concrete saw in fixed relationship to the frame, and configured for engagement with the inner surface of the depth of cut selector wheel in an normally closed position and to be received within the slot in an open position;

corresponding indicia means affixed to the concrete saw in fixed relationship to the frame and configured to indicate, in cooperation with the indicia means on the depth of cut selector wheel, alignment of said depth of cut selector wheel in a position wherein said switch is received with said slot;

a spring capable of extension under tension attached to the concrete saw in fixed relationship to the frame; and a cable attached at one end to the elevation adjustment means, frictionally engaged with the spool and at its other end to the spring, for translating elevational movement of the saw blade into rotational movement of the depth of cut indicator wheel proportional to said elevational movement of said saw blade.

4. A method of setting a maximum depth of cut of a cutting device in a material, said cutting device having a frame, said cutting device having a rotating, circular blade, said cutting device having an elevation adjustment means adjustably attached to said frame for raising and lowering said circular blade in relation to said material, said method comprising the steps of:

determining a desired depth of cut in said material;

determining a desired degree of adjustment of said elevation adjustment means corresponding to said maximum depth of cut;

monitoring an elevation of a cut made in said cutting device;

coordinating the elevation of said cut and the desired depth of said cut in said material; and limiting the elevational movement of said elevation adjustment means beyond said desired depth and degree of adjustment.

5. The method of claim 4, wherein said elevation adjustment means comprises a hydraulic cylinder attached to a pivot arm, wherein said hydraulic cylinder is able to extend and retract.

6. The method of claim 5, wherein the step of limiting the movement of said elevation adjustment means comprises inhibiting further extension of said hydraulic cylinder.

7. The method of claim 6, wherein the step of inhibiting further extension of said hydraulic cylinder further comprises an electrical contact which is broken when said elevation adjustment means is extended to the desired depth of cut.

8. In a concrete saw, having a rotating saw attached to an elevation adjustment means which is movably attached to a frame, for cutting grooves in the surface of a material at a selectable depth of cut, an apparatus for automatically setting the depth of cut, which comprises:

a shaft attached to the concrete saw in fixed relationship to the frame;

a depth of cut indicator wheel, having an inner side and an outer side, rotatably mounted on the shaft;

a spool attached to the outer side of said depth of cut indicator wheel and configured to receive in frictional engagement a cable;

a depth of cut selector wheel rotatably mounted on said shaft between said depth of cut indicator wheel and a portion of the concrete saw fixed to the frame, set depth of cut selector wheel being in sufficient frictional engagement with said depth of cut indicator wheel to enable simultaneous rotation when said depth of cut indicator wheel is rotated about the shaft yet also capable of independent manual rotation, said depth of cut selector wheel having a slot for receiving a switch and further having indicia in fixed relationship to said slot;

a switch attached to the concrete saw in fixed relationship to the frame, and configured for engagement with the inner surface of the depth of cut selector wheel in a normally closed position and to be received within the slot in an open position;

corresponding indicia means affixed to the concrete saw in fixed relationship to the frame and configured to indicate, in cooperation with the indicia means on the depth of cut selector wheel, alignment of said depth of cut selector wheel in a position wherein said switch is received with said slot;

a spring capable of extension under tension attached to the concrete saw in fixed relationship to the frame; and a cable attached at one end to the elevation adjustment means, frictionally engaged with the spool and at its other end to the spring, for translating elevational movement of the saw blade into rotational movement of the depth of cut indicator wheel proportional to said elevational movement of said saw blade.

* * * * *